US010113730B2

(12) United States Patent
Wang

(10) Patent No.: US 10,113,730 B2
(45) Date of Patent: Oct. 30, 2018

(54) SUSPENDED BULB LAMP

(71) Applicant: Jianchun Wang, Xidian Town (CN)

(72) Inventor: Jianchun Wang, Xidian Town (CN)

( * ) Notice: Subject to any disclaimer, the term of this patent is extended or adjusted under 35 U.S.C. 154(b) by 0 days.

(21) Appl. No.: 15/670,396

(22) Filed: Aug. 7, 2017

(65) Prior Publication Data

US 2018/0128469 A1 May 10, 2018

(30) Foreign Application Priority Data

Nov. 9, 2016 (CN) ..... 2016 2 1209640 U

(51) Int. Cl.

| | |
|---|---|
| ***F21V 23/04*** | (2006.01) |
| ***F21K 9/232*** | (2016.01) |
| ***F21K 9/235*** | (2016.01) |
| ***F21S 8/06*** | (2006.01) |
| ***F21S 9/02*** | (2006.01) |
| ***F21V 3/02*** | (2006.01) |
| ***F21V 17/12*** | (2006.01) |
| ***F21V 21/008*** | (2006.01) |
| ***F21V 31/00*** | (2006.01) |
| *F21Y 115/10* | (2016.01) |

(52) U.S. Cl.

CPC ..... *F21V 23/04* (2013.01); *F21K 9/232* (2016.08); *F21K 9/235* (2016.08); *F21S 8/061* (2013.01); *F21S 9/02* (2013.01); *F21V 3/02* (2013.01); *F21V 17/12* (2013.01); *F21V 21/008* (2013.01); *F21V 31/005* (2013.01); *F21Y 2115/10* (2016.08)

(58) Field of Classification Search

CPC ..... F21K 9/232; F21K 9/235; F21S 8/061; F21S 9/02; F21V 21/008; F21V 23/00; F21V 23/04; F21V 3/02; F21V 17/12; F21V 31/005; H01H 17/00; H01H 17/08

USPC ..... 362/311.02

See application file for complete search history.

(56) References Cited

U.S. PATENT DOCUMENTS

| | | | | |
|---|---|---|---|---|
| 7,804,035 | B1 * | 9/2010 | Min | F21S 8/06 200/310 |
| 2013/0214665 | A1 * | 8/2013 | Nezu | F21V 29/508 313/46 |
| 2013/0328088 | A1 * | 12/2013 | Morikawa | H01L 33/44 257/98 |

FOREIGN PATENT DOCUMENTS

| | | | | |
|---|---|---|---|---|
| CN | 204164879 U | * | 2/2015 | |
| JP | 11297119 A | * | 10/1999 | |
| WO | WO 2010041081 A1 | * | 4/2010 | H01H 3/0226 |

OTHER PUBLICATIONS

YouTube Video "Use Anywhere LED Bulb with Nylon Pull Cord", Published on Aug. 25, 2015, retrieved from https://www.youtube.com/watch?v=at2phL96tiM on May 18, 2018.*

(Continued)

*Primary Examiner* — Claude J Brown

(74) *Attorney, Agent, or Firm* — Wang Law Firm, Inc.

(57) ABSTRACT

A suspended bulb lamp includes a lamp holder; a bulb shell connected to the lamp holder; an LED light disposed inside the bulb shell and connected to the lamp holder; a pull cord for suspending the lamp holder; a lamp holder shell covering an upper portion of the lamp holder; the lamp holder shell is detachably connected to the lamp holder; a first seal ring is disposed between the lamp holder shell and the lamp holder. The waterproof performance of the bulb lamp is enhanced; moreover, since the lamp holder shell is detachably connected to the lamp holder, it is convenient to assemble the bulb lamp, and it is also convenient for a user to replace the power supply on the lamp holder.

18 Claims, 4 Drawing Sheets

(56) References Cited

OTHER PUBLICATIONS

Kikkerland Design Inc. Pull Cord Light Bulb Web Page from Internet Archive, Published at least as early as Jul. 8, 2014, retrieved from https://web.archive.org/web/20140708055752/https://kikkerland.com/products/pull-cord-light-bulb on May 18, 2018.*

* cited by examiner

SUSPENDED BULB LAMP

TECHNICAL FIELD OF THE INVENTION

The present invention relates to the technical field of suspended bulbs, and in particular to a suspended bulb lamp.

BACKGROUND OF THE INVENTION

Majority of various existing bulb lamps use LED as a light source, and are thus widely applied. However, switches for common bulb lamps are mostly conventional button switches; while for lamps to be suspended, apparently, the use of button switches is very inconvenient for operation. At present, for some suspended lamps, pull-cord switches are used. However, the design of the pull-cord switches affects the overall appearance of the lamps, and it is thus not concise and beautiful. Moreover, due to the limitation of the internal structure, the assembly is also troublesome.

To solve the problems, the Chinese Patent "SUSPENDED BULB LAMP" with a patent number of CN204164879U, comprises a lamp holder and a lamp cap, wherein a battery and a control switch are provided inside the lamp holder; the control switch is provided inside a switch base of the lamp holder, and an actuating member is provided below the control switch; a spring elastically acts on this actuating member to limit this actuating member within the switch base in such a manner of being movable up and down; one end of a pull cord for suspending the bulb lamp is connected to the actuating member, while the other end thereof passes through an opening on the top of the lamp holder and is then exposed; the lamp holder consists of a left lamp holder shell and a right lamp holder shell; after the left and right lamp holder shells are folded together, an opening for allowing the pull cord to pass therethrough is formed on the top, and an opening for mounting an LED light and a lamp cap shell is formed on the bottom; and, an annular groove buckled with an end wall of the opening is formed at an upper end of the lamp cap shell. The bulb lamp with such a structure is convenient to turn on/off. When in use, the bulb can be turned on/off simply by pulling the cord. However, since the lamp holder is formed by directly folding the left and right lamp holder shells, rain or the like is likely to enter the lamp holder through a clearance between the left and right lamp holder shells. Consequently, the battery and the circuit structure in the lamp holder are damaged, and the normal use of the bulb lamp is influenced.

Therefore, it is necessary to make further improvements to the existing suspended bulb lamps.

SUMMARY OF THE INVENTION

In view of the above-mentioned current situation in the prior art, a technical problem to be solved by the present invention is to provide a suspended bulb lamp with good waterproof performance and convenient assembly.

To solve the technical problem, the p suspended bulb lamp comprises: a lamp holder has a top and a lower portion; a bulb shell connected to the lamp holder; an LED light disposed inside the bulb shell and connected to the lamp holder; a pull cord for suspending the lamp holder; a lamp holder shell covering an upper portion of the lamp holder; wherein the bulb shell is detachably connected to the lamp holder; a first seal ring is disposed between the lamp holder shell and the lamp holder; a control switch for controlling the LED light is disposed on the top of the lamp holder; an actuating member for triggering the control switch is disposed inside the lamp holder shell; a spring acts on the actuating member to enable the actuating member to move up and down within the lamp holder shell; and, one end of the pull cord is connected to the actuating member, while the other end of the actuating member is a suspended free end. With such a structure, the on/off of the LED light can be controlled when the pull cord is pulled.

Preferably, an insertion portion is attached to a top of the lamp holder shell; a fixed member can move up and down and is surrounded by the insertion portion; the pull cord is connected to the actuating member through the fixed member; a second seal ring resists against a lower end surface of the fixed member and is surrounded by the insertion portion. With such a structure, good sealing performance is ensured at the joint of the lamp holder shell and the top of the lamp holder, and rain is prevent from entering the lamp holder from the top of the lamp holder shell.

Preferably, for convenience of connection, a first through hole s formed on a side wall of the fixed member; a connecting hole in communication with the first through hole is formed on a top of the fixed member; one end of the pull cord extends from the connecting hole to the first through hole; and, a positioning member is inserted from one end of the first through hole and pushes an end of the pull cord towards other end of the first through hole for limiting movement of the pull cord. Compared with directly passing a pull cord through a first through hole and then knotting in the prior art, the connection structure of the present invention is more rational, convenient and beautiful.

Preferably, a raised ring located below the insertion portion is disposed on the top of the lamp holder shell, an assembly sleeve for covering the fixed member surrounds the raised ring, and a second through hole for the pull cord to pass through is formed on a top of the assembly sleeve. With such a structure, the sealing performance of the top of the bulb lamp is further improved.

Preferably, a first guide groove extending is formed on an outer surface of the raised ring; a second guide groove, in communication with the first guide groove, is formed on a top surface of the lamp holder shell. When the bulb lamp is used in a rainy day, rain on the pull cord can flow downward along the first guide groove and the second guide groove. Therefore, the sealing performance inside the lamp can be ensured no matter how wet the cord is.

Preferably, a third seal ring is disposed at a joint of the bulb shell and the lamp holder, so that rain is prevented from immersing into the lamp holder from the joint of the bulb shell and the lamp holder.

Preferably, for convenience of connection, a limiting groove having an opening on one side thereof is disposed on a peripheral wall of the lower portion of the lamp holder; a limiting rib capable of rotatably sliding into the limiting groove is disposed on an inner wall of the lamp holder shell.

Preferably, the actuating member has a longitudinal cross-section which is in an inverted "T" shape, and has a circular tube extending upwardly; a through hole inside the circular tube extending toward a bottom of the actuating member, and the spring is sheathed on the circular tube; two static contact pieces are disposed on the bottom of the actuating member, and the two static contact pieces correspond to two movable contacts of the control switch and come into contact with the movable contacts; a start switch is disposed on the actuating member, by which the two static contact pieces are switched on or off.

Preferably, for convenience of connection to the actuating member, a tubular cylinder is connected to the fixed member; the tubular cylinder is inserted into the circular tube of the actuating member through the opening on the top of the lamp holder shell; the tubular cylinder and the circular tube are connected via screws.

Preferably, the start switch comprises a switch base, and an upper toothed ring and a lower toothed ring, a cap-shaped metal sheet and a small spring applying an upward spring force to the cap-shaped metal sheet, which are all successively nested together onto the switch base; an end surface of the upper toothed ring is engaged with the lower toothed ring through teeth and grooves; the upper toothed ring is limited within the switch base capable of driving the lower toothed ring and the cap-shaped metal sheet to move up or down in the axial direction, so that the cap-shaped metal sheet comes into contact with or moves away from the static contact pieces, and the two static contact pieces are thus switched on or off.

Compared with the prior art, the present invention has the following advantages; the present invention is simple and rational in structure; since a lamp holder shell capable of covering the lamp holder is disposed on the periphery of the lamp holder, the waterproof performance of the bulb lamp is enhanced; moreover, since the lamp holder shell is detachably connected to the lamp holder, it is convenient to assemble the bulb lamp, and it is also convenient for a user to replace the power supply on the lamp holder; in addition, since a plurality of seal rings are disposed on the lamp, the waterproof performance is further improved, and rain is completely prevented from immersing into the lamp holder from the top of the bulb lamp. Since the connection of the pull cord is concise and firm and the pull cord is rationally connected to an assembly for controlling an on/off action, the whole bulb lamp is more rational in structure, more convenient in assembly and more reliable in operation.

DETAILED DESCRIPTION OF THE INVENTION

Figure 1:
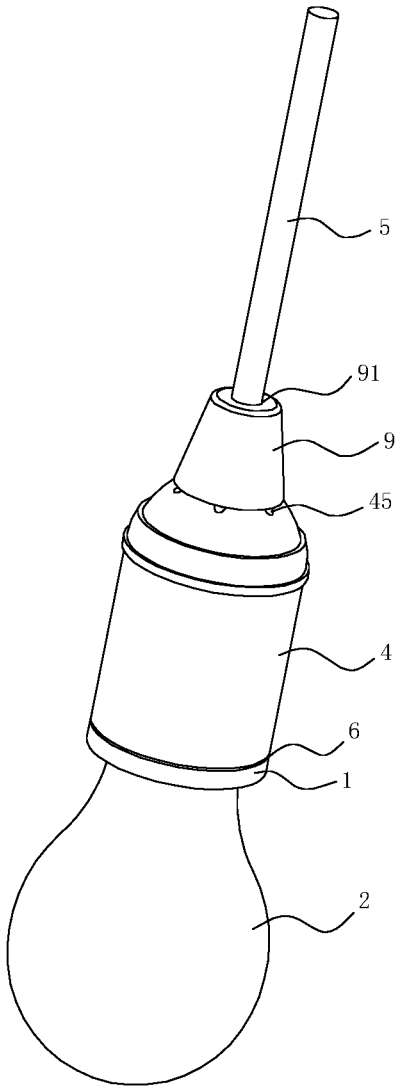
FIG. 1 is perspective view of a suspended bulb lamp according to an embodiment of the present invention.
Figure 2:
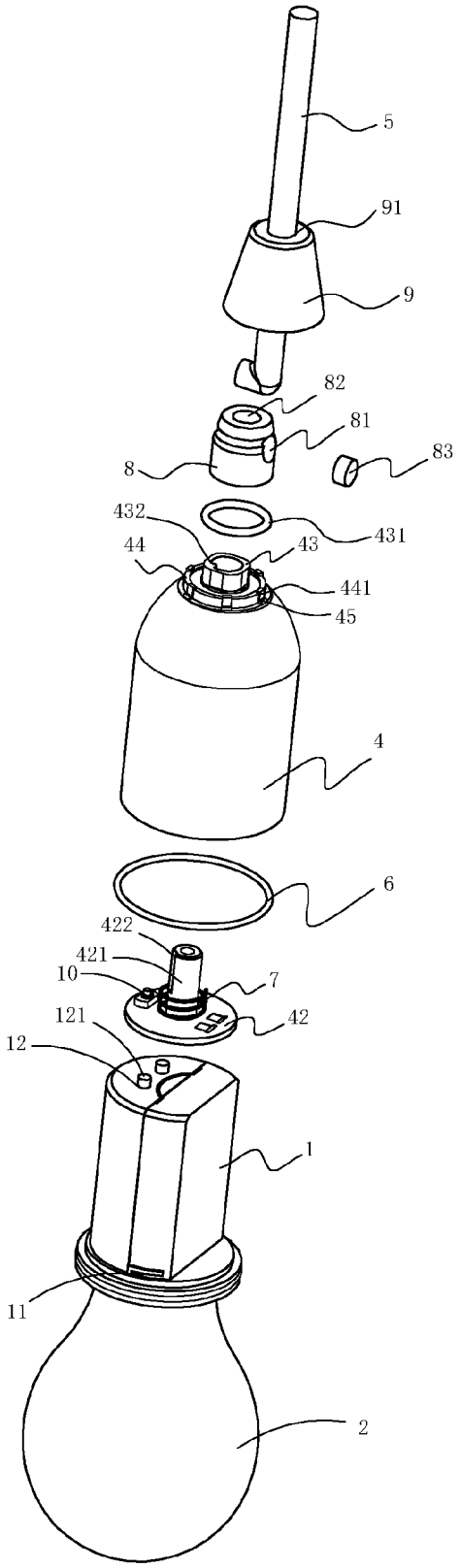
FIG. 2 is an exploded view of FIG. 1.
Figure 3:
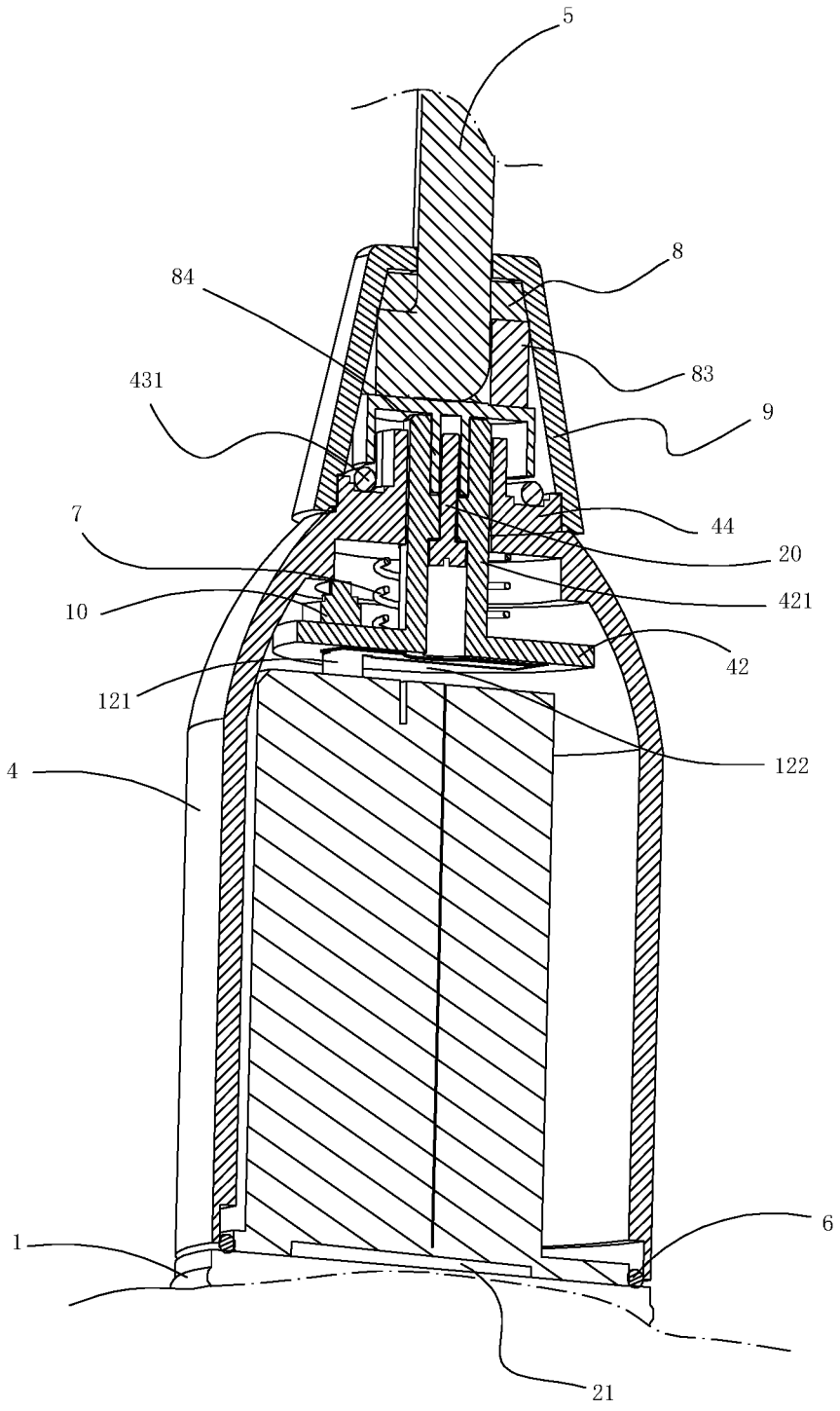
FIG. 3 is a sectional view of FIG. 1 (partial cutting off)
Figure 4:
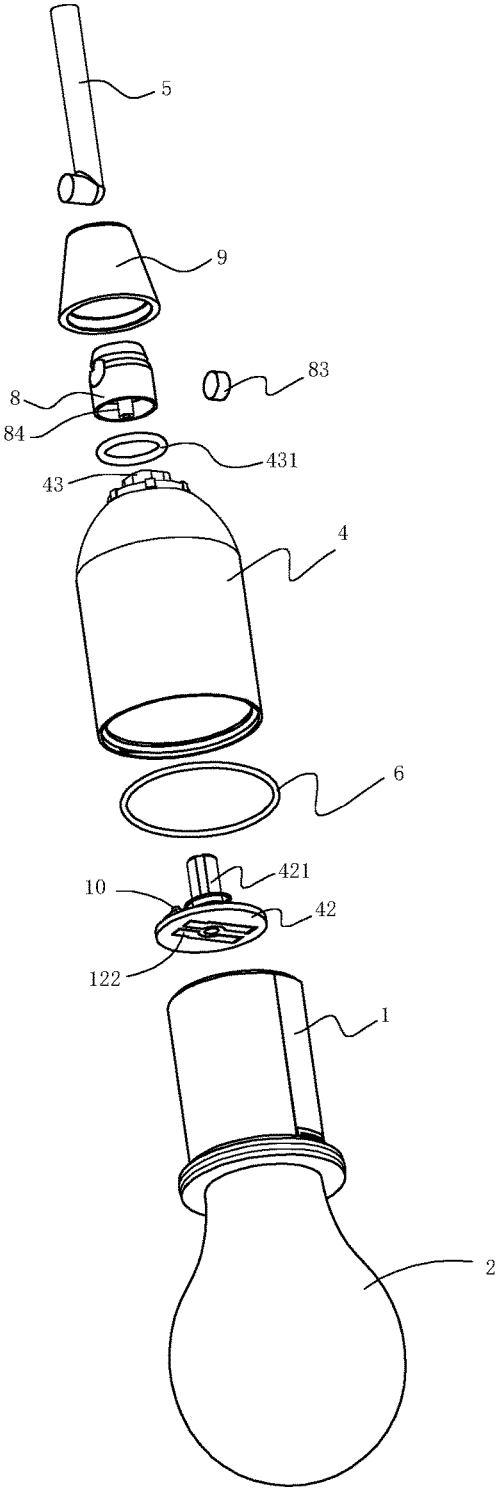
FIG. 4 is another exploded view of FIG. 1.

To enable a further understanding of the present invention content of the invention herein, refer to the detailed description of the invention and the accompanying drawings below:

FIG. 1-FIG. 4 show an embodiment of the present invention. The suspended bulb lamp comprises a lamp holder 1 has a top and a lower portion, a bulb shell 2, an LED light (not shown), a lamp holder shell 4 and a pull cord 5 for suspending the bulb lamp.

In this embodiment, a circuit assembly (not shown) is disposed inside the lamp holder 1, and a chamber for receiving a power supply is further disposed on one side of the lamp holder 1. In this embodiment, the bulb lamp can use a battery as a power supply.

In this embodiment, the bulb shell 2 is formed integrally and connected to the lamp holder 1; and, a third seal ring 21 is disposed at a joint of the bulb shell 2 and the lamp holder 1 in order to prevent rain from immersing into the lamp holder 1 from the joint of the bulb shell 2 and the lamp holder 1. In the assembled state, the third seal ring 21 is hidden within the lamp holder 1, so that the bulb lamp looks beautiful as a whole. The LED light is disposed inside the bulb shell 2 and connected to the circuit assembly in the lamp holder 1. The lamp holder shell 4 is detachably connected to the lamp holder 1 and is able to cover the top of the lamp holder 1. A limiting groove 11 having an opening on one side thereof is disposed on a peripheral wall of the lower portion of the lamp holder 1. Correspondingly, a limiting rib capable of rotatably sliding into the limiting groove is disposed on an inner wall of the lamp holder shell 4.

A first seal ring 6 is disposed between the lamp holder shell 4 and the lower portion of the lamp holder 1 in order to prevent rain from immersing into the lamp holder 1 from the joint of the lamp holder shell 4 and the lower portion of the lamp holder 1, so that the waterproof performance of the bulb lamp is enhanced. The first seal ring 6 can be exposed out of the lamp holder shell 4, or can be covered within the lamp holder shell 4.

A control switch 12 for controlling the LED light is disposed on the top of the lamp holder 1, and an actuating member 42 for triggering control switch 12 is disposed inside the lamp holder shell 4. Two static contact pieces 22 are disposed on the bottom of the actuating member 42, and the two static contact pieces 22 correspond to two movable contacts 121 of the control switch and come into contact with the movable contacts 121; the actuating member 42 has a longitudinal cross-section which is in an inverted "T" shape, and a disk-shaped bottom of the actuating member 42 has a circular tube 421 convexly extending upwardly; a through hole inside the circular tube 421 extending toward the disk-shaped bottom and a spring 7 is sheathed on the circular tube 421 of the actuating member 42; the spring 7 applies a downward spring force to the disk-shaped bottom of the actuating member 42, thus, in a state in which the pull cord is not pulled upwardly, the two static contact pieces on the actuating member are always in contact with the two movable contacts on the lamp holder; a start switch 10 is disposed on the disk-shaped bottom of the actuating member, by which the two static contact pieces 122 are switched on or off.

Figure 5:
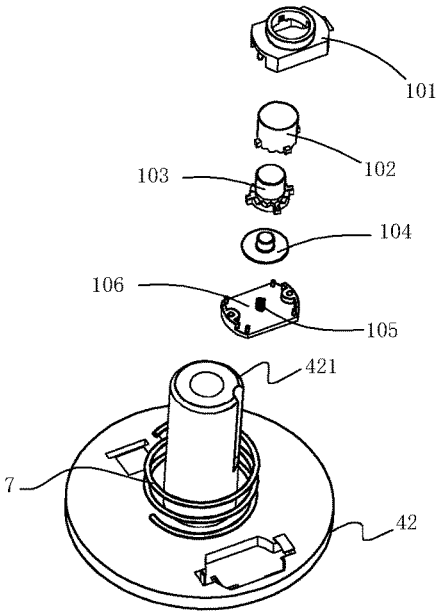
FIG. 5 is an exploded view of a start switch on an actuating member of the suspended bulb lamp according to the embodiment of the present invention.

As shown in FIG. 5, the start switch 10 mainly comprises a switch base, and an upper toothed ring 102 and a lower toothed ring 103, a cap-shaped cap-shaped metal sheet 104 and a small spring 105 applying an upward spring force to the cap-shaped metal sheet, which are all successively nested together in the switch base; the switch base is formed by buckling a base body 106 and a cover body 101 with a through hole on its top; an end surface of the upper toothed ring 102 is engaged with the lower toothed ring 103 through teeth and grooves; the upper toothed ring 102 is limited within the switch base in such a manner of moving up or down in the axial direction, through a number of limiting lugs peripherally distributed on an outer wall of the upper toothed ring and limiting grooves on the through hole of the cover body; the top of the upper toothed ring 102 is exposed out of the switch base; once the top of the upper toothed ring 102 is triggered, the lower toothed ring 103 is driven to rotate one grid, and the cap-shaped metal sheet 104 between the lower toothed ring 103 and the spring 105 moves up or down in an interlinked manner, so that the cap-shaped metal sheet 104 comes into contact with or moves away from the static contact sheets 122, and the two static contact pieces 122 are thus switched on or off; after the two static contact pieces 122 are switched on, the two static contact pieces can form a loop together with the two movable contacts 121, so that the LED light is turned on; or otherwise, the LED light is turned off.

In the bulb lamp, the static contact pieces and the movable contacts do not need to be electrically connected through leads. Therefore, the lamp holder can be disassembled completely and it is very convenient to replace the battery.

A pore is formed on the top of the lamp holder shell 4, and a neck-shaped insertion portion 43 is attached to the top of the lamp holder shell 4; a fixed member 8 is surrounded by the insertion portion 43; a second seal ring 431 capable of rests against a lower end surface of the fixed member 8 and is surrounded by the insertion portion 43, so that the top of the lamp holder shell 1 has good sealing performance, and rain is prevented from entering the lamp holder 1 from the top of the lamp holder shell 4. A raised ring 44 located below the insertion portion 43 is disposed on the top of the lamp holder shell 4; an assembly sleeve 9 for covering the fixed member 8 surrounds the raised ring 44; a second through hole 91 for the pull rod 5 to pass through is formed on a top of the assembly sleeve 9; the arrangement of the assembly sleeve can further improve the sealing performance of the top of the bulb lamp and the appearance aesthetics of the whole lamp. A first guide groove 441 is formed on an outer surface of the raised ring 44; and correspondingly, a second guide groove 45, in communication with the first guide groove 441, is formed on a top surface of the lamp holder shell 4; when the bulb lamp is used in a rainy day, rain can flow downward along the first guide groove 441 and the second guide groove 45, so that the problem that rain is likely to immerse into the lamp holder 1 from the top of the bulb lamp is avoided, and water on the pull cord is also guided along the guide grooves, so that the sealing performance of the lamp is ensured and the multi-waterproof effect is realized.

The fixed member 8 is cap-shaped, and covered on the insertion portion 43 of the lamp holder shell 4; an upper portion of the fixed member 8 is connected to the pull cord 5. Specifically, a first through hole 81 is formed on a side wall of the top of the fixed member 8; a connecting hole 82 in communication with the first through hole 81 is formed on a top of the fixed member 8; one end of the pull cord 5 extends from the first through hole 81; and, a positioning member 83 is inserted from one end of the first through hole 81 and pushes an end of the pull cord 5 toward other end of the first through hole 81 for limiting movement of the pull cord 5. After this structure is assembled, glue can be injected for fixation, so that one end of the pull cord 5 is connected to the actuating member 42 through the fixed member 8, and the other end of the pull cord 5 is a suspended free end. With this structure, the conventional connection way of knotting a pull cord of a bulb lamp is changed (the knotting has the disadvantage that the knot is large and easy to loosen), so that the connection becomes simpler and firmer.

The lower portion of the fixed member 8 is connected to the actuating member 42 located within the lamp holder shell 4. Specifically, a tubular cylinder 84 is connected to the fixed member 8, and the tubular cylinder 84 is inserted into the circular tube 421 of the actuating member 42 through the opening on the top of the lamp holder shell 4; and, the actuating member 42 and the fixed member 8 are connected via a screw 20 screwing from the disk-shaped bottom of the actuating member 42, so that the actuating member 42 and the fixed member 8 synchronously move up or down under the drive of the pull cord 5. Additionally, a limiting structure consisting of a groove 422 and a rib 432 is formed between an outer wall of the circular tube 421 of the actuating member 42 and an inner wall of the opening on the top of the lamp holder shell 4, in order to radially limit the actuating member 2 and guide the upward/downward movement of the actuating member 42. During the assembly, the actuating member 42 sheathed with the spring 7 is put into the lamp holder shell 4, and the groove 422 on the circular tube is engaged with the rib 432 on an inner wall of the lamp holder shell; the fixed member 8 is placed on the top of the lamp holder shell 4 and the tubular cylinder 84 on the fixed member is inserted into the circular tube 421 of the actuating member 42; subsequently, a self-tapping screw 20 is inserted from the disk-shaped bottom of the actuating member 42 to connect the actuating member 42 to the fixed member 8. The assembly process is convenient and simple. A step is disposed inside the lamp holder shell 4. After the actuating member 42 is connected to the fixed member 8, an upper end of the spring 7 sheathed on the circular tube 421 comes into contact with a scapular plane and thus comes into a pre-compressed state. Thus, by pulling the pull cord 5, the actuating member 42 can be driven to move up; and, the actuating member 42 can be reset due to the spring force. In turn, the upward/downward movement of the actuating member 42 can trigger the start switch 10 (during the upward movement, the top of the upper toothed ring 102 comes into contact with the inner wall of the lamp holder shell 4) and the control switch 12, so that the LED light is turned on or off.

The invention claimed is:

1. A suspended bulb lamp comprising:

a lamp holder with a top and a lower portion;

a bulb shell connected to the lamp holder;

an LED light disposed inside the bulb shell and connected to the lamp holder;

a pull cord for suspending the lamp holder having two ends;

a lamp holder shell covering an upper portion of the lamp holder;

wherein, the lamp holder shell is detachably connected to the lamp holder;

a first seal ring is disposed between the lamp holder shell and the lamp holder;

a control switch for controlling the LED light is disposed on the top of the lamp holder;

an actuating member for triggering the control switch is disposed inside the lamp holder shell;

a spring acts on the actuating member to enable the actuating member to move up and down within the lamp holder shell; and one end of the pull cord is connected to the actuating member, while the other end of the pull cord is a suspended free end.

2. The lamp of claim 1, wherein an insertion portion is attached to a top of the lamp holder shell;

a fixed member is connected to the actuating member and can move up and down, the fixed member is surrounded by the insertion portion;

the pull cord is connected to the actuating member through the fixed member;

a second seal ring rests against a lower end surface of the fixed member and is surrounded by the insertion portion.

3. The lamp of claim 2, wherein a first through hole is formed on a side wall of the fixed member;

a connecting hole in communication with the first through hole is formed on a top of the fixed member;

one end of the pull cord extends from the connecting hole to the first through hole; and a positioning member is inserted from one end of the first through hole and pushes an end of the pull cord toward other end of the first through hole for limiting movement of the pull cord.

4. The lamp of claim 3, wherein a third seal ring is disposed at a joint of the bulb shell and the lamp holder.

5. The lamp of claim 3, wherein a limiting groove having an opening on one side thereof is disposed on a peripheral wall of the lower portion of the lamp holder;

a limiting rib capable of rotatably sliding into the limiting groove is disposed on an inner wall of the lamp holder shell.

6. The lamp of claim 2, wherein a raised ring located below the insertion portion is disposed on the top of the lamp holder shell;

an assembly sleeve for covering the fixed member surrounds the raised ring; and a second through hole for the pull cord to pass through is formed on a top of the assembly sleeve.

7. The lamp of claim 6, wherein a first guide groove is formed on an outer surface of the raised ring;

a second guide groove, in communication with the first guide groove, is formed on a top surface of the lamp holder shell.

8. The lamp of claim 7, wherein a third seal ring is disposed at a joint of the bulb shell and the lamp holder.

9. The lamp of claim 7, wherein a limiting groove having an opening on one side thereof is disposed on a peripheral wall of the lower portion of the lamp holder;

a limiting rib capable of rotatably sliding into the limiting groove is disposed on an inner wall of the lamp holder shell.

10. The lamp of claim 6, wherein a third seal ring is disposed at a joint of the bulb shell and the lamp holder.

11. The lamp of claim 6, wherein a limiting groove having an opening on one side thereof is disposed on a peripheral wall of the lower portion of the lamp holder;

a limiting rib capable of rotatably sliding into the limiting groove is disposed on an inner wall of the lamp holder shell.

12. The lamp of claim 2, wherein the actuating member has a longitudinal cross-section which is in an inverted "T" shape, and has a circular tube extending upwardly;

a through hole inside the circular tube extending toward a bottom of the actuating member, and the spring is sheathed on the circular tube;

two static contact pieces are disposed on the bottom of the actuating member, and the two static contact pieces correspond to two movable contacts of the control switch and come into contact with the movable contacts;

a start switch is disposed on the actuating member, by which the two static contact pieces are switched on or off.

13. The lamp of claim 12, wherein a tubular cylinder is connected to the fixed member;

the tubular cylinder is inserted into the circular tube of the actuating member through the opening on the top of the lamp holder shell;

the tubular cylinder and the circular tube are connected via screws.

14. The lamp of claim 12, wherein the start switch comprises a switch base, and an upper toothed ring and a lower toothed ring, a cap-shaped metal sheet and a small spring applying an upward spring force to the metal sheet, which are successively nested together onto the switch base;

an end surface of the upper toothed ring is engaged with the lower toothed ring through teeth and grooves; and the upper toothed ring is limited within the switch base capable of driving the lower toothed ring and the metal sheet to move up or down in the axial direction.

15. The lamp of claim 2, wherein a third seal ring is disposed at a joint of the bulb shell and the lamp holder.

16. The lamp of claim 2, wherein a limiting groove having an opening on one side thereof is disposed on a peripheral wall of the lower portion of the lamp holder;

a limiting rib capable of rotatably sliding into the limiting groove is disposed on an inner wall of the lamp holder shell.

17. The lamp of claim 1, wherein a third seal ring is disposed at a joint of the bulb shell and the lamp holder.

18. The lamp of claim 1, wherein a limiting groove having an opening on one side thereof is disposed on a peripheral wall of the lower portion of the lamp holder;

a limiting rib capable of rotatably sliding into the limiting groove is disposed on an inner wall of the lamp holder shell.

* * * * *